United States Patent [19]

Bitner et al.

[11] Patent Number: 4,833,615

[45] Date of Patent: May 23, 1989

[54] SYSTEM FOR THE PROTECTION OF AN AERIAL DEVICE HAVING A PIVOTABLE BOOM

[75] Inventors: C. Ellsworth Bitner, Quakertown; John D. Harris, East Whiteland Township, Chester County; Richard D. Belcher, Tredyffrin Township, Chester County, all of Pa.

[73] Assignee: A.G.A. Credit, Kulpsville, Pa.

[21] Appl. No.: 84,100

[22] Filed: Aug. 10, 1987

Related U.S. Application Data

[63] Continuation of Ser. No. 919,328, Oct. 15, 1986, which is a continuation of Ser. No. 767,769, Aug. 21, 1985, abandoned, which is a continuation of Ser. No. 312,707, Oct. 19, 1981, abandoned.

[51] Int. Cl.[4] ..... B66C 23/00

[52] U.S. Cl. ..... 364/463; 364/424.07; 364/559; 340/685

[58] Field of Search ..... 364/463, 567, 424, 434, 364/200, 900, 559; 340/685; 73/862.56, 826.58; 212/149-156

[56] References Cited

U.S. PATENT DOCUMENTS

| | | | |
|---|---|---|---|
| 3,072,264 | 1/1963 | Sennebogen | 212/150 |
| 3,200,963 | 7/1963 | Vermes | 212/157 |
| 3,489,294 | 1/1970 | Greb et al. | 212/150 |
| 3,550,506 | 12/1970 | Gardenhour | 212/145 |
| 3,586,841 | 6/1971 | Griffin | 364/508 |
| 3,612,294 | 10/1971 | Wilkinson | 212/150 |
| 3,638,211 | 1/1972 | Sanchez | 340/267 |
| 3,680,714 | 8/1972 | Holmes | 212/154 |
| 3,713,129 | 1/1973 | Buchholz | 340/267 C |
| 3,735,876 | 5/1973 | Brownell et al. | 212/151 |
| 3,740,534 | 6/1973 | Kezer et al. | 364/463 |
| 3,774,217 | 11/1973 | Bonner et al. | 212/151 |
| 3,848,750 | 11/1974 | Hoge | 212/69 |
| 3,893,573 | 7/1975 | Fletcher et al. | 244/161 X |
| 4,003,482 | 1/1977 | Cheze | 212/155 |
| 4,016,535 | 4/1977 | Dinlocker | 340/52 H |
| 4,052,602 | 10/1977 | Horn et al. | 212/155 |
| 4,064,997 | 12/1977 | Holland et al. | 212/39 B |
| 4,158,885 | 6/1970 | Neuberger | 364/460 |
| 4,185,280 | 1/1980 | Wilhelm | 340/685 |
| 4,205,308 | 5/1980 | Haley et al. | 364/559 X |
| 4,216,868 | 8/1980 | Geppert | 212/155 |
| 4,236,864 | 12/1980 | Couture et al. | 340/685 |
| 4,368,824 | 1/1983 | Thomasson | 364/685 |
| 4,456,093 | 6/1984 | Finley et al. | 364/463 |
| 4,516,117 | 5/1985 | Couture et al. | 340/685 |

FOREIGN PATENT DOCUMENTS 1437588 5/1976 United Kingdom .

*Primary Examiner*—Parshotam S. Lall
*Assistant Examiner*—Thomas G. Black
*Attorney, Agent, or Firm*—Weiser & Stapler

[57] ABSTRACT

A mobile aerial device, which also has deployable outriggers, has sensors for the outrigger-supported weight, sensors for boom azimuth, elevation and extension, and sensors for other boom conditions. An on-board digital computer is programmed with load tables for the device. The various sensor signals and load table data are computer-processed to determine the approach of tipping or overload conditions. When operating near a dangerous obstacle which it is desired to avoid, the boom is initially caused to assume certain preparatory positions relative to the obstacle and data are computer-generated which extrapolate from these positions a region in space which represents a prohibitively close approach of the boom to the obstacle. The foregoing information is used to alert the operator to the approach of a dangerous condition and also to prevent the crane from performing movements which could cause tipping or which would encroach upon the prohibited region.

43 Claims, 3 Drawing Sheets

SYSTEM FOR THE PROTECTION OF AN AERIAL DEVICE HAVING A PIVOTABLE BOOM

RELATED CASES

This is a continuation of prior copending United States patent application Ser. No. 919,328, filed Oct. 15, 1986; which is a continuation of United States patent application Ser. No. 767,769, filed Aug. 21, 1985 and since abandoned; and a continuation of United States patent application Ser. No. 312,707, filed Oct. 19, 1981 and since abandoned.

BACKGROUND OF THE INVENTION

The present invention relates to what are commonly referred to as "aerial devices". This is the term used to generically designate a variety of devices for lifting, positioning and holding useful loads above ground level. They include cranes of various types, which use a boom whose end supports a hook, or equivalent attachment means, which can be raised or lowered by means of cables and by which a load can therefore be lifted.

They also include devices which support a load at the end of the boom, without the additional use of a cable lifting mechanism. For example, a fire hose nozzle can be so supported, or a tree-trimming saw, or a platform for a worker, etc.

In all such devices, it is common that the boom itself also is capable of displacement in various respects. It is typically rotatable in azimuth, it is typically movable in elevation, and it is typically extendable, through the use of plural sections which telescope with respect to one another, and sometimes also through the use of additional extensions known as jibs and flys.

The present invention relates to all the foregoing types of aerial devices.

Moreover, although not limited thereto, the present invention relates particularly to such aerial devices, which are readily mobile, in order that they be conveniently and quickly used in various locations and under varying conditions. Such mobile aerial devices are further frequently characterized by having their own wheels, usually in the form of rubber tires, by means of which they can easily be moved from one work location to another. In addition, many though by no means all such mobile devices also have outriggers which can be deployed while the device is at one particular work location. Such outriggers are intended, when deployed, to take the place of the wheels as the supports for the device while it is being used to perform its lifting or supporting functions. Generally, when resting on outriggers, the device has greater performance capabilities than when resting on its wheels.

It will be apparent, that, in devices of the sort under consideration, there are encountered numerous serious problems pertaining to safety. These safety problems can affect the device itself, the load lifted or supported by the device, its human operator, and even other nearby structures not on board of, or attached to the aerial device itself.

A particular form of the aerial devices under consideration, which is subject to a representative variety of those safety problems, is that which is frequently used in carrying out such tasks as electric power line maintenance and repair. Such power lines are typically strung over considerable distances over a variety of terrain. They are supported at a considerable height above ground level, but this height can vary from one span between supporting pylons to another. It is frequently not practical to deenergize them during routine maintenance operatins, as this would interrupt the supply of electrical power which the line is expected to provide.

The type of aerial device which has been used frequently in these circumstances is one that is self-propelled, and therefore has its own transport wheels. It also has outriggers which can be deployed if desired while it is not in rolling motion. Finally it has a telescoping boom, sometimes with optional attachments for a load-bearing hook and lifting cables, on the one hand, and a work platform or basket on the other hand. Jib and fly may also be provided.

As for the safety problems, these include the danger of tipping of the device, if the safe limits of load are exceeded. They include the danger of bending or even breaking of the boom for the same reason. They include the danger of electric shock if the power line is accidentally contacted. And they include the danger of damage to the power line, again in case of unintentional contact.

It is not desired to create the impression that the present invention resides in recognizing problems and dangers such as those mentioned above. Most, if not all of these problems have been known to those skilled in the art, and various attempts have been made to deal with them. These attempts have met with only limited success, due to various factors, particularly the very complex interaction between what might be called the "geometry" of the aerial device itself, the load, and the location of an external object such as the power line.

Thus it is well known that an aerial device is capable of lifting safely different weights of load depending upon the length of extension of the boom, its angle of elevation, and its angle of azimuth. Moreover, all of these parameters are generally different, if the device is a self-propelled one with outriggers, depending on whether or not the outriggers are deployed.

So-called load tables are generally provided by the manufacturer of a particular aerial device, which provide data concerning the foregoing parameters. These tables could, in theory, be used by the device operator to remain within safe limits, insofar as the load weight is concerned. However, in an actual operating situation, it is burdensome and time-consuming to have to resort to such load tables. Moreover, one ingredient in using those tables, namely the weight of the load, is typically known only with low precision, if at all. Therefore, in practice, these load tables are used only in a limited way and are frequently ignored altogether.

Moreover, even if they were used, and used effectively, they would still be of no help whatsoever in dealing with the danger of contacting external objects, which remains unsolved even if the load-related aspects of aerial device operation are conducted within completely safe limits.

SUMMARY OF THE INVENTION

Accordingly, it is an object of the present invention to provide apparatus which alleviates one or more of the prior art problems discussed above.

It is another object to provide an aerial device with improved protection against problems and dangers associated with the weight of the load.

It is another object to provide an aerial device with improved protection against dangers from and to objects external to the device, but not arising from the weight of the load, as such.

It is another object to provide an aerial device with improved protection in both of the respects mentioned above, namely load weight and external objects.

It is another object to achieve the foregoing objects in a manner which requires a minimum of intervention by the human operator of the aerial device.

It is another object to achieve the said objects in a manner which requires only a modest amount of operator training, and which actually reduces the amount of operator experience that would be required for safe operation in the absence of the present invention.

It is another object to provide the external object protection in a manner which is highly flexible and adaptive to a variety of configurations and positions of the external objects.

It is another object to provide the improved protection in relation to external objects, without the use of means for detecting the proximity of such objects.

It is another object to provide the improved protection of the present invention without perceptible modification of the conventional appearance of the aerial device and without interfering with its conventional method of operation.

These and other objects of the present invention which will appear are achieved as follows.

A digital computer is provided on board the device, equipped in conventional manner with a microprocessor, a read-only memory (ROM) and a random access memory (RAM). By means of suitable programming, there are introduced into the processor memory a variety of instructions as discussed more fully below. These include the data which correspond to conventional load tables or charts for the particular aerial device to be protected in accordance with the present invention.

Means are provided for sensing the conditions which determine which load table data are applicable at any particular time. Means are further provided for sensing the load weight and the boom geometry (length, azimuth, elevation), and the controls which actuate the movements of the boom are disabled when they attempt to cause approach to a condition which the load table data indicate to be dangerous.

In an outrigger-deployed condition, means are provided for sensing the loads on the outriggers and for providing an indication of danger that the aerial device may tip over.

Finally, means are provided for introducing into the computer memory certain data concerning the relationship between the boom of the device and an object external to the device with which contact is to be avoided. This is accomplished by causing the boom initially to assume certain preparatory positions relative to the external object to be avoided, and generating data which extrapolate from these positions a region in space which represents a prohibitively close approach of the boom to the object to be avoided. This data is then utilized, in conjunction with data denoting the actual position of the boom at any given time, to disable the boom actuating controls whenever the boom attempts to approach dangerously close to the external object to be avoided.

For further details, reference is made to the discussion which follows, in light of the accompanying drawings.

BRIEF DESCRIPTION OF THE DRAWINGS

The same reference numerals are used to designate similar elements in the different drawings.

DESCRIPTION OF THE PREFERRED EMBODIMENT

Before proceeding to the detailed discussion of the Figures, it is desired to state generally that the invention will be described in its application to a mobile crane which can, in most respects, be completely conventional.

For that reason, and because this crane can take any one of various known forms, no one of which is preferred insofar as the present invention is concerned, the crane itself is not illustrated, nor described in any great detail herein. Suffice it to say that the crane itself is characterized in that it may have a mechanically telescoping boom, with a manually extensible fly, for providing boom extension beyond the mechanically telescoping sections of the boom, and a jib for providing an additional extension, if desired. The boom is rotatable in azimuth (sometimes called slew) and also in elevation (sometimes called luff). The rotatable portion of the crane (sometimes called upper) is pivotally attached to the crane carrier (sometimes called lower), and the carrier itself is made mobile through being mounted on tires (sometimes referred to as rubber). The crane is also equipped with four outriggers which can either be raised, so that the weight of the crane and its load, if any, is supported on the tires (rubber), or they can be deployed beyond the edges of the carrier and lowered to the ground, in such manner that the weight rests on these outriggers. This normally imparts increased stability to the crane.

Figure 1:
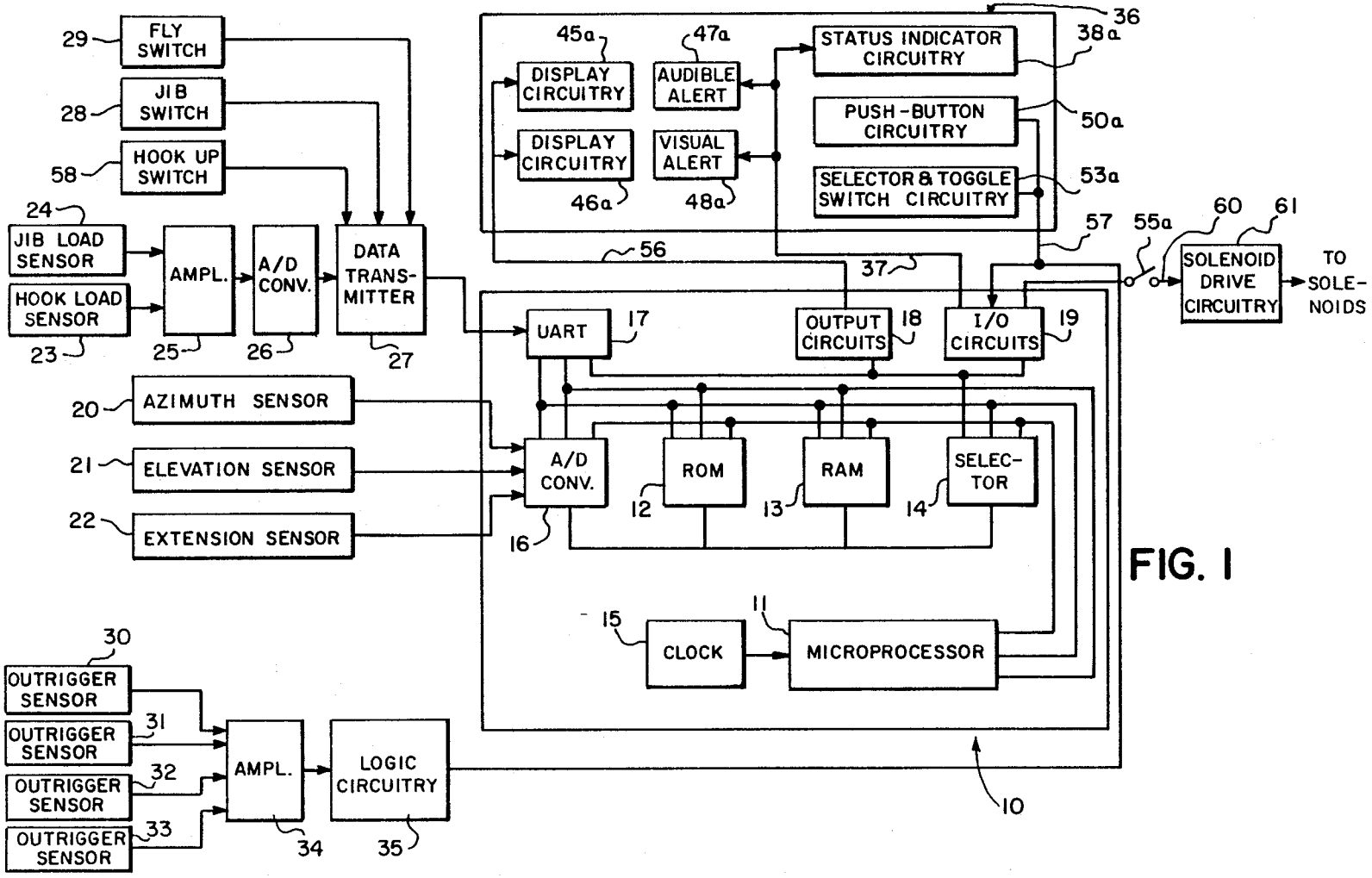
FIG. 1 is an overall block diagram of a preferred embodiment of an aerial device protection system in accordance with the present invention.

Referring now to FIG. 1, this shows a system which embodies the present invention, and which is adapted to be mounted on board the crane previously characterized. The system has as its core a digital electronic computer 10. As is apparent from the drawing, this computer 10 has components, and these components are organized within computer 10, in a manner which in itself is entirely conventional. Thus it includes a microprocessor 11, a read-only memory (ROM) 12, which is preferably of programmable variety (i.e. a PROM), a random access read/write memory (RAM) 13, memory and input/output (I/O) selector circuitry 14, and a clock generator 15 to supply time base for the entire system. In addition, there is multiplexed anolog-to-digital (A/D) converter circuitry 16, universal asynchronous receive-transmit (UART) circuitry 17, interface circuitry 18 with an alphanumeric display (discussed later), and interface circuitry 19 with other portions of the system (also discussed later).

Numerous inputs are provided to computer 10, which supply information concerning the physical state of the crane at any given time.

Specifically, three transducers 20, 21 and 22 are provided to supply, respectively, input signals to computer 10 representing the angular position of the boom in azimuth, the angular position of the boom in elevation, and finally the length of boom extension. These three transducers 20, 21 and 22 may take any of various known forms. For example, the angle-indicating transducers 20 and 21 may take the form of potentiometers, respectively rotated in response to rotary (angular) movement of the boom in azimuth and elevation. As for length-indicating transducer 22, this may also take the form of a potentiometer, but in this case rotated by a cable attached at one end to the end of the boom, and wrapped at the other end around a shaft which rotates in unison with the potentiometer shaft.

The analog signals from these transducers 20, 21 and 22 are supplied to A/D converter 16, to place them into proper format for subsequent processing by computer 10.

Another signal which is also supplied to computer 10 is derived from one or the other of transducers 23 and 24.

Each of these transducers 23 and 24 is constructed and arranged to produce a signal which represents the weight of the load which exists at the end of the boom in a given instance. Specifically, transducer 23 is physically mounted so as to sense that weight when the load is supported at the end of the extendable telescopic sections of the boom. Transducer 24 is physically mounted so as to sense the weight when the load is supported at the end of the jib extension from the boom. The transducers 23 and 24 may take known forms, being for example in the form of strain gages attached to the end of the mechanically extensible boom sections, and to the end of the jib extension, respectively.

The strains developed at these locations and sensed by transducers 23 and 24, evidently are representative of the weight of the load, which gives rise to this strain.

After suitable amplification in amplifier 25, these strain gage output signals are supplied to an A/D converter 26, and thence to a signal data transmitter 27. This transmitter in turn forwards the signals to computer 10 via the UART 17, for subsequent processing by the computer.

Also introduced into the system at the transmitter 27 are additional signals which indicate whether the jib is in use or not, and whether the fly is in use or not. This may be accomplished by means of simple switches 28 and 29, which are mounted at the connection between jib and boom and at the connection between fly and boom, respectively, so as to be mechanically actuated when their respective boom extensions are put into use.

Still another set of transducers is provided for sensing the forces which are exerted by the crane, in its entirety, upon the outriggers. There are four such transducers, designated by reference numerals 30, 31, 32 and 33 in FIG. 1, one for each individual outrigger. They may take known forms. For example, they may be strain gages which are attached to sense the strain produced by the load in the respective outriggers.

Their output signals, after suitable amplification in amplifier 34, are supplied to logic circuitry 35, and thence to an input of I/O circuitry 19, for further processing in computer 10.

The logic circuitry 35 utilizes the amplified signals from the transducers 30–33 to supply three possible signals to I/O circuitry 19. One such signal indicates that the outriggers are not deployed. Another indicates that the outriggers are deployed but that the total weight and weight distribution resting on these outriggers is such that the crane is no longer completely safe from tipping over. The third indicates that a condition even closer to tipping has been reached.

The foregoing may be accomplished as follows.

The individual output signal from each transducer 30–33 is supplied to three different signal paths. In one of these paths there is a detector which is so biased that the signal passes through that detector only when the weight sensed by the corresponding transducer has become zero. This condition, of course, occurs when the particular outrigger is not supporting any weight, which normally denotes that it is not deployed. An AND gate may be used to produce a signal, when the above-mentioned zero-weight signals are being provided from all four transducers. This AND gate output signal therefore denotes non-deployment of the outriggers. Absence of the signal of course denotes the converse.

Another one of the signal paths from each transducer 30–33 has in it a detector which is biased so that the transducer signal passes through it when the weight sensed by the corresponding transducer has declined below the weight which would be supported by the outrigger to which that transducer is attached when the crane is completely stable, resting firmly on all four outriggers. In this case, the signals from the detectors are processed so that, so long as any three (or more) out of the four detectors do not pass the respective transducer signal, one output signal is produced by the processing, whereas a different signal is produced when three or more of these detectors do pass the transducer signals.

The former condition is taken to indicate that the crane is resting stably on its outriggers, safe from tipping. The reason why three signals of the proper magnitude are considered sufficient is that three support points normally suffice for stability.

Finally, the third signal path from each transducer 30–33 has in it another detector, which is so biased as to pass a signal only when that signal represents a still further decline in the weight resting on the corresponding outrigger. Again, the signals from the four detectors are processed on a three-out-of-four basis to produce different output signals. One of these output signals indicates again that the danger of tipping has now reached a higher level, while the other output signal indicates the converse.

In each instance, the three-out-of-four signals may be produced, by connecting four detector outputs, in different conbinations of three, to four AND gates, and by further connecting the outputs of those AND gates to an OR gate.

Thus, it will be seen that the logic circuitry 35 in effect provides three different possible signal states. One state indicates that the outriggers are not deployed at all. Another state indicates that a condition exists in which the danger of tipping is being approached. A third state indicates that the danger of tipping has been approached even more closely. Of course, the absence of all three of these signal states indicates that the outriggers are deployed, but there is no danger of tipping.

Further refinements may be provided. The strain gages used as transducers 30–33 are normally connected in bridge circuit configuration. To prevent the failure of one of these gages from falsely creating a signal state indicating that the crane is safe from tipping, there are further provided within logic circuitry 35 detectors which sense the production by the strain gage bridge circuits of signals whose amplitude lies outside the rather narrow range of values which prevail during proper operation. These abnormal signals are also used to alert and stop further crane movement, pending investigation of the abnormality.

The computer 10 and the remainder of the systems utilize the signals which are supplied to it from logic circuitry 35 in the following manner.

Figure 2:
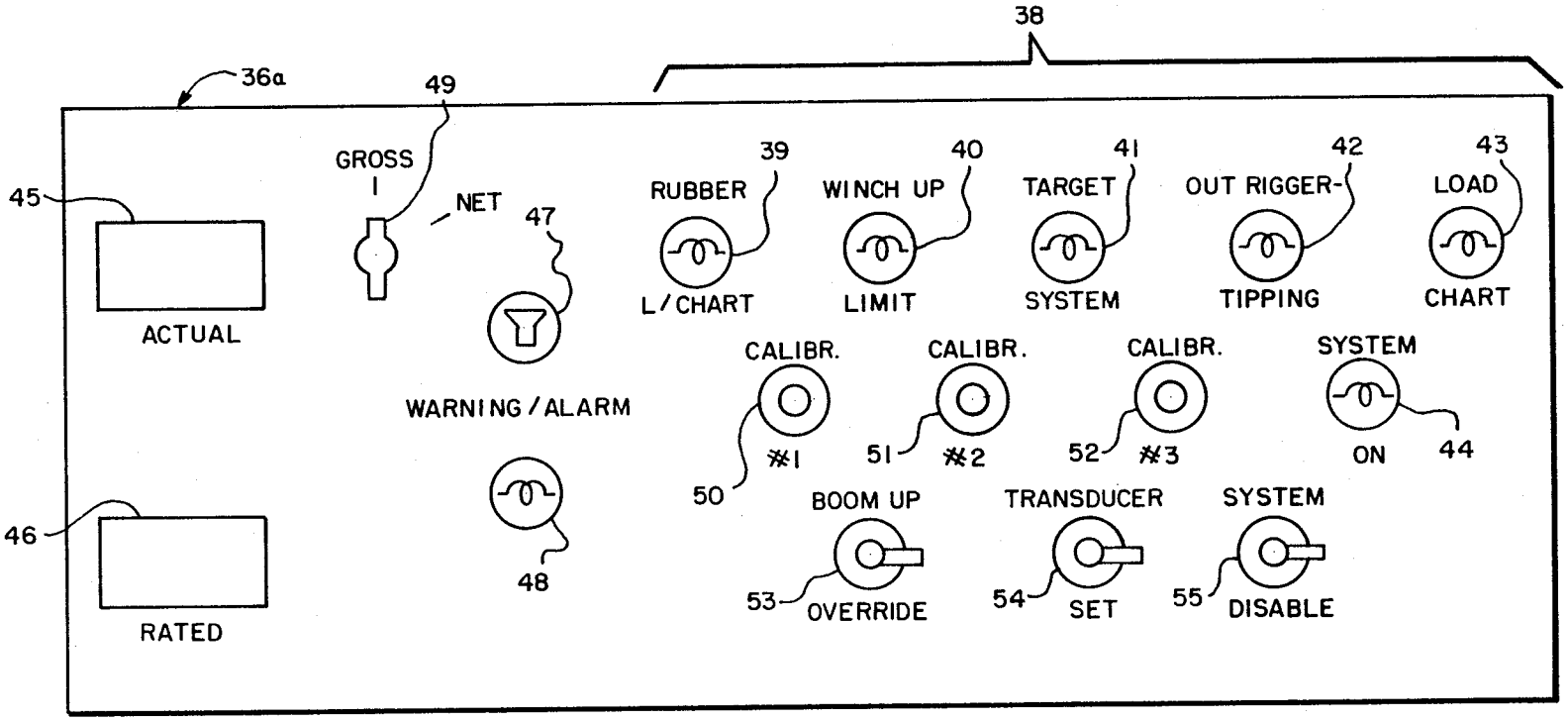
FIG. 2 is a diagram of the operator display and control panel for the system of FIG. 1.

In what follows, reference should be made not only to FIG. 1, but also to FIG. 2, as appropriate. This FIG. 2 shows the front panel 36*a*, containing the operator-exposed portions of the same display and control unit 36 as appears in block diagram form in FIG. 1. These exposed portions on front panel 36*a* include a plurality of status indicators, which are collectively designated by reference numeral 38 in FIG. 2. The corresponding control and operating circuitry for these status indicators 38 is designated by reference numeral 38*a* in FIG. 1.

The status indicators 38 are all in the form of indicator lamps. There are six of these lamps, designated by reference numerals 39 through 44 in FIG. 2.

In addition to these indicator lamps 39–44, there are on the front panel 36*a* two alphanumeric LED displays 45 and 46, an audible alerting device 47, e.g. an electronically operated loudspeaker capable of producing a horn-like sound, a visual alerting device in the form of indicator lamp 48, and a selector switch 49 associated with the LED displays in a manner described further below. There are also three pushbutton switches 50, 51 and 52, and three toggle switches 53, 54 and 55.

Associated with all these elements of the operator-exposed portions of unit 36 is, of course, the corresponding electronic drive circuitry within unit 36, and there are also the necessary interconnections to computer 10.

Thus, the LED displays 45 and 46 are associated with LED display circuitry 45*a* and 46*a*, which, in turn, receives its control signals from display output circuits 18 via display bus 56. The alert indicators 47, 48 have drive circuits 47*a*, 48*a*, the pushbutton switches 50–52 and the toggle and selector switches 53–55 and 49 are connected through circuitry 50*a* and 53*a* to switch bus 57, which in turn leads to I/O circuitry 19.

All of this drive and connecting circuitry associated with unit 36 may take any conventional form, and is therefore not described in further detail herein.

Reverting now to what happens to the output signals from logic circuitry 35 in FIG. 1, when these signals indicate that the outriggers of the crane are not deployed, a signal is transmitted through indicator bus 37 and status indicator circuitry 38*a* which energizes lamp 39 (FIG. 2). As shown in FIG. 2, this lamp is designated by the words RUBBER L CHART, the letter L standing for the word load. This lamp, which is preferably white, thereupon lights up and indicates to the crane operator that the condition described above prevails, namely that the crane is being supported by its wheels (rubber) and not by the outriggers.

Several other events are caused by this signal logic circuitry 35.

One is that the computer refers to that load chart which applies when the crane is supported by its wheels rather than by its outriggers. In turn, this interacts with the alerting system, which then utilizes the comparison between the load chart data for that situation and the data from the various sensors which sense the boom position and the load conditions, namely sensors 20–24, to determine whether there exists a safe condition, or an unsafe or potentially unsafe condition in terms of overload of the boom and/or in terms of tipping of the crane.

As long as the conditions are safe in all respects, the audible alerting device 47 remains silent and the visual alerting device 48 remains unlit. If a condition is determined to exist, by means of the comparisons described above, which begins to approach the unsafe condition within predetermined limits, then the audible alerting device 47 and the visual alerting device 48 are both actuated. Under those circumstances they are actuated in an intermittent manner, e.g. at a 4 Hz rate. If then the condition worsens so as to approach a condition of overload and/or a conditon of tipping even more closely (i.e. to within a lesser predetermined limit), these two alerting devices 47 and 48 become actuated on a continuous basis so that a continuous horn sound is produced by audible alerting device 47, and continuous illumination of visual alerting device 48 takes place.

Alphanumeric displays 45 and 46 show crane loading figures. Alphanumeric display 45 shows the actual load which is being supported by the crane at a given time. That is what is meant by the word ACTUAL applied next to display 45. Alphanumeric display 46 shows the load which, in accordance with the load table then in use, the crane is safely permitted to support. This is what is meant by the word RATED which is applied next to display 46. By use of selector switch 49 (FIG. 2), these alphanumeric displays 45 and 46 may be caused to show the respective figures for either the total (GROSS) weight of the load or the net weight. By "net weight" is meant the total weight of the load minus the weight which was present when the NET setting of switch 49 was selected. This is typically used to obtain tare weight. It should be noted that, while the actual weight shown by display 45 does not vary as a function of the crane geometry, the rated figure does vary as a function of crane geometry as determined by the load tables for the crane.

Assume now further that there is a signal produced by logic circuitry 35 which represents either of the two possible approaches to tipping previously discussed, namely the more remote of the two approaches and the closer one. In either case, the audible and visual alerting devices 47 and 48 will be actuated, intermittently in the former case and continuously in the latter. At the same time, indicator lamp 42 which is labeled OUTRIGGER TIPPING will be energized. In this way, the operator is able to tell at a glance that there is an approaching unsafe condition, how close to being unsafe it is, and what its cause is.

Preferably, the load chart which applies during times when the crane is resting on outriggers also continues to be utilized for comparison in the same manner as previously discussed for the load chart which applies when the crane is on rubber. If this comparison indicates an approach to an unsafe condition, independently of whether this is also indicated by the logic circuitry 35, the alerting devices 47 and 48 are again actuated. Simultaneously, the indicator lamp 43, which is labeled LOAD CHART in FIG. 2, is energized, thereby indicating the source of this information about the approach to a dangerous condition. Thus redundancy of protection is provided.

Turning now to indicator lamp 40 in FIG. 2, which is labeled with the words WINCH UP LIMIT, this lamp is energized through the circuitry 38*a* in FIG. 1 whenever the hook of the crane (with or without load attached) reaches the highest position which it is capable of achieving. This position is sensed by a switch 58 (FIG. 1) which is suitably positioned physically with respect to the up and down movement of the hook. The output signal from this switch 58 is also supplied to data transmitting circuit 27 and from there is processed through the computer 10 in order to energize indicator lamp 40 as previously described. Energization of indicator lamp 40 also simultaneously actuates the alerting means 47 and 48. In this case, there is only one alert condition, namely that in which the hook has reached the topmost position and this is signaled by continuous activation of alert means 47 and 48. This indication of a hook-up condition differs from other alert conditions previously described in that it does not give any separate indication of an approach to the limiting condition.

Turning now further to indicator lamp 41 in FIG. 2, which is labeled with the words TARGET SYSTEM, this lamp becomes energized through circuitry 38*a* whenever a condition is created through movement of the boom in a manner which would bring that boom into dangerously close proximity to an external object. This lamp 41, and the portions of circuitry 38*a* associated with it, are further associated with the pushbutton switches 50 through 52 and indicator lamp 44 and their associated circuitry 58. The manner in which all this functions is described below.

Let it be assumed that the crane which is involved is to be used in connection with the maintenance of an electric powerline. It is then desired to have the boom be capable of being swung in azimuth and elevation and also extended and retracted with the maximum degree of freedom relative to the powerline, but without ever contacting the powerline. Indeed, in order to provide a margin of safety against contacting the powerline, it is desired to have the boom never approach the powerline beyond certain distance limits.

In accordance with the present invention these approach limitations are imposed through the following procedures.

The crane as a whole is initially moved to that position in relation to the powerline from which it would normally be desired to operate. This will typically be somewhat to the side of the powerline but close enough so that the extended boom is capable of reaching beyond the powerline to the side remote from the crane and its end can swing upwardly to a level at least as high as the powerline. With the crane as a whole in that position, the boom is then rotated in azimuth until it extends toward the powerline, perpendicularly to that line. In addition, the boom is extended until it reaches beyond the powerline to the opposite side from the crane and its angle of elevation is so adjusted that it passes beneath the powerline. More particularly, the boom is raised in elevation until its closest point of approach to the powerline from below is within what are considered safe distance limits. At that time, pushbutton 50, which is designated with the legend CALIBRATE NO. 1, is depressed by the crane operator. This depression of switch 50, through circuitry 50*a*; and computer 10, causes the then-existing azimuth and elevation of the boom, as sensed by sensors 20 and 21, to be stored in the memory of computer 10.

As will be explained more fully hereafter, the computer 10 is programmed not only to store this data but also to use it to mathematically define a plane which parallels the powerline and which slopes upwardly, from the side of the powerline on which the crane is positioned (which will be referred to as the "front" of the powerline) to the opposite side of the powerline (which will be referred to as the "rear" of the powerline), with the center line of the extended boom also located within that plane.

The next step in the procedure is to re-position the boom so that its extreme end is on the same side of the powerline as the crane, i.e. on the front side of the powerline, and also at a distance, both horizontally and vertically from the powerline which is considered within safe limits. While the boom is in that position, pushbutton 51 in FIG. 2, which is designated with the label CALIBRATE NO. 2, is depressed by the operator. This causes to be stored in the memory of computer 10 the angular elevation of the boom and its length, as indicated respectively by elevation sensor 21 and length sensor 22. In addition, the computer 10 is programmed in such a manner as to mathematically define a vertical plane extending through the extreme end of the boom in this position and a horizontal plane likewise extending through the boom end in this same position, both of these planes being also parallel to the powerline.

Figure 3:
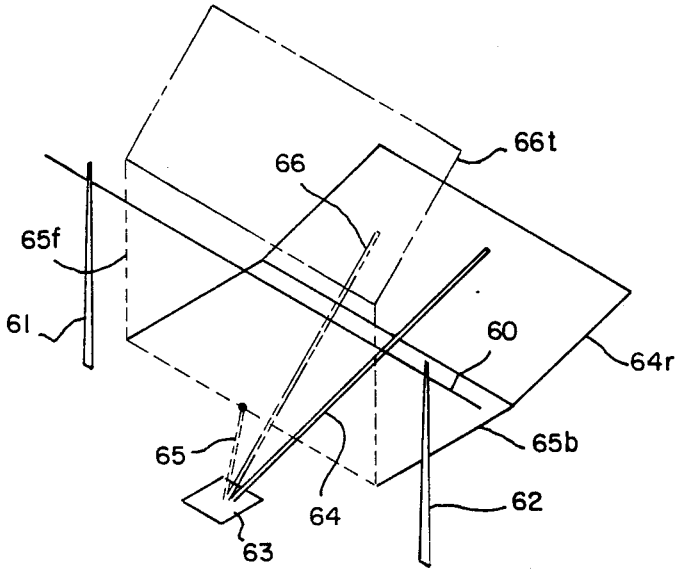
FIG. 3 is an isometric skeleton diagram which will be used in explaning the operation of the system of FIGS. 1 and 2.

Consequently, through the series of procedural steps described above, there is created within computer 10 a mathematically defined set of planes positioned with respect to the powerline in a manner shown in FIG. 3 of the drawings. There, the powerline 60 is assumed to be a substantially straight line supported above ground level by means of pylons 61, 62. The crane is symbolically represented by rectangle 63 in FIG. 3, where it is seen to be positioned on the ground, alongside of but to one side of the powerline 60, this side being the front previously defined. The two different boom positions assumed during the procedure previously described are illustrated symbolically by the solid line 64 and the broken line 65 in FIG. 3. The operations involving the boom position illustrated by solid line 64 in FIG. 3 give rise to the sloping plane 64*r* in FIG. 3. The portion of the procedure followed in connection with the boom position illustrated by the broken line 65 gives rise to the vertical plane 65*f* and the horizontal plane 65*b*. These planes 64*r*, 65*f* and 65*b* will be referred to hereafter as the rear plane, the front plane, and the bottom plane, respectively, corresponding to the suffixes r, f and b. The reason is that these planes define the limits of approach to the powerline of the boom from the corresponding directions. That is, the rear plane 64*r* defines the limit of approach of the boom to the powerline from the rear, i.e. from the side of the powerline facing away from the crane 63. The front plane 65*f* defines the limit of approach of the crane to the powerline 60 from the front, i.e. from the same side on which the crane 63 itself is positioned. Finally, the bottom plane 65*b* defines the limit of appoach of the boom from the bottom, i.e. from ground level up.

Incidentally, the carrying out of the procedure described above, including as the final step the depression of the pushbutton 51, also causes indicator lamp 44 to be energized. This informs the crane operator that the protection system under discussion has been put into operation.

Having once defined the protective planes 64*r*, 65*f* and 65*b* of FIG. 3 as described above, the computer 10 is programmed to continuously compare the position of the boom, in all three respects, namely azimuth, elevation and extension, with the locations of the protective planes and to assist the operator in preventing the boom from approaching the powerline more closely than the limits defined by these planes. This it does in two ways, namely by alerting the operator and also by influencing directly the mechanical operation of the crane.

The former is accomplished by utilizing a signal from the computer 10 supplied by I/O circuitry 19 and indicator bus 37 to activate both the audible and the visual alerting means of 47 and 48, as well as energizing the indicator lamp 41, thereby informing the operator of the source of the alert indications.

Again only a continuous alert indication is provided by the audible and visual indicators 47 and 48.

The second way in which it does so is by supplying, through I/O circuitry 19 and via solenoid bus 60, control signals to solenoid drive circuitry 61 which in turn controls the hydraulic solenoids which are utilized in conventional manner within the crane operating hydraulics to cause the boom to move in azimuth, elevation, and extension. More specifically this solenoid drive circuitry 61 is so controlled via solenoid bus 60 from the computer 10 that further movement in any of the foregoing respects becomes blocked in that direction, or in those directions, in which such movement would cause the boom to penetrate further into the prohibited region in space which is established by planes **64*r*, 65*f* and 65*b* in FIG. 3**.

Thus, the invention not only provides to the operator an alert indication of dangerously close approach to the obstacle (powerline 60 in FIG. 3), but it also automatically prevents the boom from coming too close, let alone coming into contact with the powerline 60.

It will now be understood that the fundamental concept which underlies the protection, in accordance with the present invention, from the danger of undesired contact between the crane and an external object (such as a powerline) involves utilizing the boom of the crane initially to assume certain preparatory positions representing the limit of approach to the object from those directions from which such approach may take place during the actual operation of the crane in its intended use. The "geometry" which exists in these preparatory positions is then introduced into the memory of the computer 10. The computer is also preprogrammed to utilize this data to mathematically generate surfaces which represent the closest permissible approach of the boom to the external object during actual use of the crane. The computer is further preprogrammed to continuously compare the position of the boom, as it moves during its actual use, with these limiting surfaces and to both alert the operator when such movement pierces one of the surfaces, which have been pre-established as explained above, as well as to stop subsequent movement of the crane which would further penetrate such surface. Conversely subsequent movements which would not cause penetration are not inhibited by the present invention.

With this in mind, it will be apparent that the three planes **64*r*, 65*f* and 65*b* which are illustrated in FIG. 3**, and which have previously been discussed, are not the only ones which can be used in this manner.

For example, if, in practical use of the crane, it is also desired to have the boom extend above the powerline from the front (as previously defined) to its rear (as previously defined), then an additional protective plane should be, and preferably is introduced, in the following manner.

Referring again to FIG. 3, in the preparatory stage the boom of crane 63 is swung into a position as shown in dot-dash lines at 66. This is a position in which the boom extends diagonally above and beyond the powerline 60. Push-button 52 in FIG. 2, which bears the label CALIBRATE #3 is then depressed. This stores in the memory of computer 10 the boom azimuth and elevation data which exist at that time, derived from azimuth and elevation transducers 20 and 21 in FIG. 1. The computer is preprogrammed to utilize this azimuth and elevation data to calculate a plane **66*t* shown in dot dash lines in FIG. 3. This plane 66*t* like plane 64*r* slopes diagonally upwardly away from crane 63, and includes the line defined by the boom in its position 66 in FIG. 3. This constitutes what might be called the top plane of the protected space, as denoted by the suffix "t" accompanying the reference numberal 66**, and defines the closest limit of approach from the top to the powerline.

When such a top plane is used, consideration must also be given to the following. As long as the boom of the crane is used only to support some working element, right at its end, but with no vertical downward extension, it suffices to continuously sense the position of the boom, compare it with the location of the top plane **66*t*, and provide an alert as well as movement inhibition when the boom threatens to pierce that plane 66*t*** in its downwardly movement toward the powerline.

On the other hand, if the load supported by the boom is capable of being lowered from the end of the boom, e.g. in the normal operation of a crane with a load supporting hook which can be lowered from the end of the boom on a cable, then it is evidently possible for the boom itself to be safely above top plane **66*t* (FIG. 3) and yet the load itself could potentially pierce this plane 66*t* through being lowered by means of the cable. To prevent this, it would suffice to provide an additional transducer (not shown) which measures the length of the cable, and to include in the preprogramming of the computer the instructions which are necessary to use this cable length as an additional variable in determining whether not only the boom itself but also the load at the end of the cable threatens to pierce the top plane 66*t* (FIG. 3**). Conventional means for sensing the cable length would be a potentiometer, which rotates in unison with the reel which causes the cable to be payed out or to be reeled in.

In the computer program which is provided at the end of this Specification, provision has not been made for utilizing the additional features which are discussed above in connection with top plane **66*t* and push-button 52 in FIG. 2**. However, it is believed that the manner of introduction of such additional preprogramming would be readily apparent to those skilled in the art.

On the other hand, additional features which have been included within the computer program provided at the end of this Specification are the following.

A condition in operating the crane can arise in which it is not possible to have its boom assume the position illustrated at 64 in FIG. 3, namely a position pointing directly toward the powerline. This can arise, for example, if the adjacent pylons 61, 62 are too close together to permit the boom to be swung between them.

Figure 4:
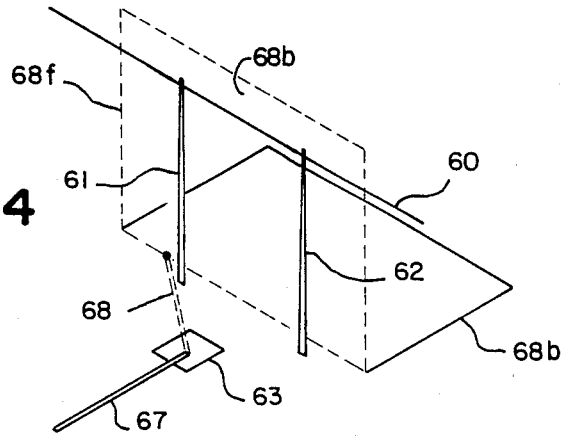
FIG. 4 is another isometric skeleton diagram which will be used in explaining the operation of the system.

Under these conditions, a different procedure is followed, as illustrated in FIG. 4.

First, the boom shown at 67 in FIG. 4 is pointed directly away from powerline 60 (rather than directly toward it, as in FIG. 3). Also, it is depressed slightly below the horizontal. Then pushbutton 50 (CALIBRATE #1) is depressed. Thereafter the boom is placed in a position illustrated in broken lines at 68 in FIG. 4. This position is chosen such that the end of the boom is at the corner defined by a vertical front plane 68*f*, safely in front of the powerline 60, and a horizontal bottom plane 68*b*, safely below the powerline 60. Pushbutton 51 (CALIBRATE #2) in FIG. 2 is then depressed. Thereupon the two protective front and bottom planes mentioned above are put into effect by the system.

Another condition in operating the crane which requires special treatment can arise, if this crane were to be positioned either directly or nearly directly below the powerline. In that case it is no longer desirable to define the front plane 65*f* as shown in FIG. 3, namely as a vertical plane. The reason is that, under those circumstances, it can be shown that an unsafe region can exist in the corner between the bottom and front planes (65*b* and 65*f* in FIG. 3). In accordance with the present invention, this condition is preferably dealt with as follows.

Figure 5:
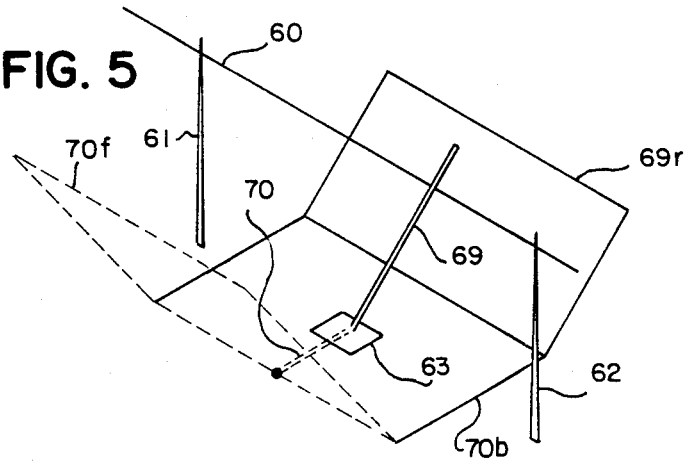
FIG. 5 is still another such explanatory diagram.

Referring to FIG. 5, the crane 63 is there seen to be positioned essentially directly below powerline 60. The boom is then caused to assume a position 69, in which it points toward the rear of the powerline (as was the case at 64 in FIG. 3). Push-button 50 in FIG. 2 is then depressed, and a sloping rear plane 69*r* is thereby defined. The boom of crane 63 is then swung around to point diagonally upward at the front of powerline 60, as shown by broken line 70 in FIG. 5. Note that this swing required a change of azimuth which is more than 90° away from the direction (69) which the boom previously occupied. The end of boom 70 is placed at the desired location of the intersection (corner) between front plane and bottom plane and push-button 51 is then depressed. This causes the definition of a bottom plane 70*b* and of a front plane 70*f*. The latter now slopes diagonally upward from crane 63 and away from powerline 60, rather than extending vertically in front of powerline 60, as had been the case for front plane 65*f* in FIG. 3.

In other respects, the subsequent operation of the system remains the same, that is, operator alerting and movement inhibiting events take place if the boom seeks to penetrate the prohibited space defined in the manner illustrated in FIG. 5.

Numerous other configurations of protective surfaces can be envisioned and provided in accordance with the present invention, again by utilizing suitable preparatory positions for the boom of the crane, and providing the appropriate preprogramming of computer 10 to generate mathematically the geometric protective surfaces with which subsequent boom positions and movement can be compared in order to provide the desired protection.

On front panel 36*a* (FIG. 2) there is also provided a toggle switch 53 labeled BOOM-UP OVERRIDE. This switch has the purpose of enabling the crane operator to cause the boom to move in an upward direction, even though the load chart-based or the outrigger sensor-based indications are of an approach to an unsafe condition.

Preferably switch 53 also serves a second, entirely different function. This is to initially enable operation of the crane movements following computer start-up. This is a safety feature which prevents inadvertent operation of the crane, after the object-protective surfaces have been lost from computer memory due to intentional or unintentional power interruptions.

Also on front panel 36*a* there is provided a toggle switch 54, which is labeled TRANSDUCER SET. This toggle switch provides a procedure for checking the various sensors for correct operation. It accomplishes this as follows. It causes the displays 45 and 46 to cease displaying crane load figures, and instead display the data provided by boom azimuth, elevation and extension sensors 20, 21 and 22. Also, if an object-protecting plane, defined as previously explained, has been pierced, this is displayed.

Finally on front panel 36*a* there is a toggle switch 55 which is labeled SYSTEM DIABLE. This switch 55, whose electrical circuitry 55*a* appears in FIG. 1, has the purpose of completely disabling the automatic protection system embodying the invention which is provided through solenoid bus 60 and solenoid driver circuitry 61. When this switch 55 is thrown, the movement control signals from computer 10 cease to be transmitted to the boom movement control devices, and boom movement therefore can continue to be controlled manually in any desired manner, irrespective of the operation of the system of FIG. 1 and 2. On the other hand, the alert indications which are provided on the front panel 36*a* in various ways, as previously discussed, are unaffected by this SYSTEM DISABLE switch 55, and continue to be provided to the operator.

It will be apparent that various modifications of the invention are possible without departing from the inventive concept, which it is therefore desired to limit only by the appended claims.

For example, in place of load tables, some manufacturers of aerial devices provide comparable information about safe operating limits in the form of curves, or algorithms. These can, of course, be used in the same manner as the load tables in accordance with the present invention.

In place of strain gages, other equivalent sensors may be used such as so-called LVDT's (linear variable displacement transducers).

It will also be understood that the invention is not limited to aerial devices working in the vicinity of powerlines. Rather the same concepts apply to the prevention of unduly close proximity between this device and any other object such as portions of an offshore drilling rig, the wall of a building, and so forth.

With respect to all of these, the invention makes it possible to position the aerial device in the desired location relative to the object and then erect what might be called "invisible walls" for mutual protection.

We claim:

1. A method of operating an aerial device including a carrier and a boom pivotally associated with said carrier, said boom having means for telescoping and elevating with respect to said carrier, which method comprises the steps of:

monitoring location of said boom relative to said carrier during said operating, including sensing an azimuth defining the pivotal location of said boom with respect to said carrier, sensing the elevation of said boom with respect to said carrier, and sensing an extension defining the telescoping of said boom with respect to said carrier;

causing the boom to assume a preparatory position in predetermined spatial relationship to a stationary object which is randomly oriented with respect to said carrier;

utilizing the azimuth, elevation and extension sensed in said preparatory position to automatically define a surface in spaced relation to said object to define a region surrounding at least portions of said object and which is penetrable by said boom during unrestricted operation of the boom; and utilizing the azimuth, elevation and extension sensed during subsequent operation of said boom to automatically provide an alert signal when the boom attempts to come closer than said surface to the object.

2. The method of claim 1 wherein said alert signal is provided irrespective of the pivoting, the telescoping and the elevating of said boom during subsequent operation of said boom.

3. The method of claim 2 wherein said alert signal is provided without redefining said surface during said subsequent operations.

4. The method of claim 1 wherein the defining of said surface is performed by a digital computer.

5. The method of claim 1 which further comprises the steps of:

causing the boom to assume a second preparatory position in a different spatial relationship to the object; and utilizing the azimuth, elevation and extension sensed in said second preparatory position to define another surface spaced from said object.

6. The method of claim 5 wherein said plurality of surfaces defines a predetermined volume to be avoided.

7. The method of claim 5 wherein a surface is defined for each preparatory position assumed by said boom.

8. The method of claim 1 wherein the alert signal is an audible and visual signal.

9. The method of claim 1 wherein the alert signal causes inhibition of further movement of the boom toward said object, but permits further movement of the boom away from said object.

10. The method of claim 1 wherein end portions of said boom opposite the carrier include means for suspending an article from said boom, and wherein said method further comprises the steps of:

monitoring location of the suspended article by sensing the location of the end portions of said boom; and utilizing said monitored location of the suspended article and the sensed azimuth, elevation and extension of said boom to provide the alert signal when the suspended article attempts to come closer than said surface to the object.

11. The method of claim 1 which further comprises the steps of:

sensing loading on the boom;

comparing the loading, responsive to sensed azimuth, elevation and extension of the boom, with load charts indicating safe operating limits for said aerial device; and providing the alert signal when the comparison approaches the safe limits of aerial device operation as defined by the load charts.

12. The method of claim 11 wherein said carrier includes a plurality of stabilizing supports, and wherein said method further comprises the steps of:

determining the number of stabilizing supports which are being subjected to a load; and providing the alert signal according to the determined number of unloaded supports.

13. The method of claim 11 wherein said carrier includes a plurality of stabilizing supports, and wherein said method further comprises the steps of:

sensing distribution of the loading of the boom on the plurality of supports;

determining when said distribution approaches a condition in which there is danger of boom tipping; and utilizing said determination to provide said alert signal.

14. The method of claim 13 which further comprises the steps of determining the number of stabilizing supports which are being subjected to a load, and providing the alert signal according to the determined number of unloaded supports.

15. The method of claim 11 wherein said comparing includes:

sensing when the loading exceeds a first predetermined level indicative of unsafe operating conditions;

providing a first warning signal in response to said sensing;

further sensing when the loading exceeds a second predetermined level, greater than said first level and indicative of boom tipping; and providing a second warning signal, different from said first warning signal, in response to said further sensing.

16. The method of claim 15 wherein said carrier includes a plurality of stabilizing supports, and wherein said method further comprises the steps of:

determining the number of stabilizing supports which are being subjected to a load; and providing the first and second warning signals according to the determined number of unloaded supports.

17. The method of claim 11 wherein the alert signal inhibits further movement of the boom toward positions which would increase said loading, but permits further movement of the boom away from positions which would increase said loading.

18. A system for operating an aerial device including a carrier and a boom pivotally associated with said carrier, said boom having means for telescoping and elevating with respect to said carrier, and said system comprising:

means associated with said aerial device for monitoring location of the boom relative to said carrier during said operating, including means for sensing an azimuth defining the pivotal location of said boom with respect to said carrier, means for sensing the elevation of said boom with respect to said carrier, and means for sensing an extension defining the telescoping of said boom with respect to said carrier;

means associated with said aerial device for causing the boom to assume a preparatory position in predetermined spatial relationship to a stationary object which is randomly oriented with respect to said carrier;

means associated with said monitoring means for utilizing the azimuth, elevation and extension sensed by said sensing means in said preparatory position to automatically define a surface in spaced relation to said object to define a region surrounding at least portions of said object and which is penetrable by said during unrestricted operation of the boom; and means associated with said monitoring means and said region defining means for utilizing the azimuth, elevation and extension sensed by said sensing means during subsequent operation of said boom to automatically provide an alert signal when the boom attempts to come closer than said surface to the object.

19. The system of claim 18 wherein said alert signal providing means operates irrespective of subsequent pivoting, telescoping and elevating of said boom.

20. The system of claim 19 wherein subsequent operation of said alert signal providing means procedes without redefining said surface.

21. The system of claim 18 wherein movement of the boom is capable of regulation by means of a plurality of relays, and wherein said alert signal providing means further comprises means for controlling said relays so that further movement of the boom toward said object is inhibited, but further movement of the boom away from said object is permitted.

22. The system of claim 18 which further comprises:

means for sensing loading on the boom;

means for comparing the loading sensed by said sensing means, responsive to the sensed azimuth, elevation and extension of the boom, with load charts indicating safe operating limits for said aerial device; and means for providing the alert signal when the comparison approaches the safe limits of aerial device operation as defined by the load charts.

23. The system of claim 22 which further comprises:

means for sensing distribution of the loading of the boom on a plurality of outrigger means deployed to provide stabilizing support for the carrier of said aerial device;

means for determining when the distribution approaches a condition in which there is danger of boom tipping; and means for utilizing said determination to provide said alert signal.

24. The system of claim 23 wherein movement of the boom is capable of regulation by means of a plurality of relays, and wherein said alert signal providing means further comprises means for controlling said relays so that further movement of the boom toward positions which would increase said loading is inhibited, but further movement of the boom away from positions which would increase said loading is permitted.

25. The system of claim 23 wherein the loading distribution is sensed by the weight supported by different ones of the plurality of outrigger means.

26. The system of claim 25 wherein the sensing that the weight being supported by each of the outrigger means is not above a predetermined level is utilized to provide an indication that the outrigger means are not deployed.

27. The system of claim 25 wherein three or more outrigger means are deployed in support of the carrier, and the alert signal is provided when the weight sensed on each of two adjacent outrigger means is below a predetermined level.

28. An apparatus comprising an aerial device including a carrier and a boom pivotally associated with said carrier, and a system produced in accordance with claim 18.

29. A method of operating an aerial device including a carrier and a boom pivotally associated with said carrier, said boom having means for telescoping with respect to said carrier, which method comprises the steps of:

monitoring location of said boom relative to said carrier during said operating, including sensing an azimuth defining the pivotal location of said boom with respect to said carrier, and sensing an extension defining the telescoping of said boom with respect to said carrier;

causing the boom to assume a first preparatory position in predetermined spatial relationship to a stationary object which is randomly oriented with respect to said carrier;

utilizing the azimuth and extension sensed in said preparatory position to automatically define a surface in spaced relation to said object to define a region surrounding at least portions of said object and which is penetrable by said boom during unrestricted operation of the boom; and utilizing the azimuth and extension sensed during subsequent operation of said boom to automatically provide an alert signal when the boom attempts to come closer than said surface to the object.

30. The method of claim 29 which further comprises the steps of:

causing the boom to assume a second preparatory position in a different spatial relationship to the object; and utilizing the azimuth, elevation and extension sensed in said second position to define another surface spaced from said object.

31. The method of claim 30 wherein a surface is defined for each preparatory position assumed by said boom.

32. A method of operating an aerial device including a carrier and a boom pivotally associated with said carrier, said boom having means for elevating with respect to said carrier, which method comprises the steps of:

monitoring location of said boom relative to said carrier during said operating, including sensing an azimuth defining the pivotal location of said boom with respect to said carrier, and sensing the elevation of said boom with respect to said carrier;

causing the boom to assume a first preparatory position in predetermined spatial relationship to a stationary object which is randomly oriented with respect to said carrier;

utilizing the azimuth and elevation sensed in said preparatory position to automatically define a surface in spaced relation to said object to define a region surrounding at least portions of said object and which is penetrable by said boom during unrestricted operation of the boom; and utilizing the azimuth and elevation sensed during subsequent operation of said boom to automatically provide an alert signal when the boom attempts to come closer than said surface to the object.

33. The method of claim 32 which further comprises the steps of:

causing the boom to assume a second preparatory position in a different spatial relationship to the object; and utilizing the azimuth, elevation and extension sensed in said second position to define another surface spaced from said object.

34. The method of claim 33 wherein a surface is defined for each preparatory position assumed by said boom.

35. A system for operating an aerial device including a carrier and a boom pivotally associated with said carrier, said carrier including a plurality of stabilizing supports, said boom having means for moving with respect to said carrier, and end portions of said boom including means for suspending an article from said boom, said system comprising:

means for sensing loading on the boom;

means for sensing distribution of the loading of the boom on the plurality of stabilizing supports of the carrier; and means for determining when said distribution approaches a condition in which there is a danger of boom tipping including means for comparing decreases in the loading of the boom on the plurality of stabilizing supports, responsive to changes in azimuth, elevation and extension of the boom, with load charts indicating safe operating limits for said aerial device.

36. The system of claim 35 wherein said system includes means for providing an alert signal responsive to the loading determined by said loading determining means.

37. The system of claim 35 wherein the loading distribution is sensed by the weight supported by different ones of the plurality of outrigger means.

38. The system of claim 37 wherein the sensing that the weight being supported by each of the outrigger means is not above a predetermined level is utilized to provide an indication that the outrigger means are not deployed.

39. The system of claim 37 wherein three or more outrigger means are deployed in support of the carrier, and the alert signal is provided when the weight sensed on each of two adjacent outrigger means is below a predetermined level.

40. A method for operating an aerial device including a carrier and a boom pivotally associated with said carrier, said carrier including a plurality of stabilizing supports, said boom having means for moving with respect to said carrier, and end portions of said boom including means for suspending an article from said boom, which method comprises the steps of:

sensing loading on the boom;

sensing distribution of the loading of the boom on the plurality of stabilizing supports of the carrier;

determining when said distribution approaches a condition in which there is a danger of boom tipping by comparing decreases in the loading of the boom on the plurality of stabilizing supports, responsive to changes in azimuth, elevation and extension of the boom, with load charts indicating safe operating limits for said aerial device; and providing an alert signal when the comparison approaches the safe limits of aerial device operation as defined by the load charts.

41. The method of claim 40 which further comprises the steps of:

determining the number of stabilizing supports which are being subjected to a load; and providing the alert signal according to the determined number of unloaded supports.

42. The method of claim 40 wherein said comparing includes:

sensing when the loading exceeds a first predetermined level indicative of unsafe operating conditions;

providing a first warning signal in response to said sensing;

further sensing when the loading exceeds a second predetermined level, greater than said first level and indicative of boom tipping; and providing a second warning signal, different from said first warning signal, in response to said further sensing.

43. The method of claim 40 wherein the alert signal inhibits further movement of the boom toward positions which would increase said loading, but permits further movement of the boom away from positions which would increase said loading.--

* * * * *